US007246541B1

(12) United States Patent
Divack

(10) Patent No.: US 7,246,541 B1
(45) Date of Patent: Jul. 24, 2007

(54) PIPEFITTING ENGAGING TOOL ASSEMBLY

(76) Inventor: Robin M. Divack, 256 B Main St., Millburn, NJ (US) 07041

( * ) Notice: Subject to any disclaimer, the term of this patent is extended or adjusted under 35 U.S.C. 154(b) by 94 days.

(21) Appl. No.: 11/150,766

(22) Filed: Jun. 13, 2005

(51) Int. Cl.
*B25B 17/00* (2006.01)
*B25B 21/00* (2006.01)

(52) U.S. Cl. ..... 81/57.15; 81/57.11; 81/57.14; 81/57.2

(58) Field of Classification Search .... 81/57.14–57.17, 81/57.2, 57.34, 60, 63.1, 63.2, 58, 58.1, 58.2, 81/124.1, 124.2, 90.2, 90.4, 90.6
See application file for complete search history.

(56) References Cited

U.S. PATENT DOCUMENTS

| | | | | |
|---|---|---|---|---|
| 384,040 | A | 6/1888 | Johnson | |
| 1,871,857 | A * | 8/1932 | Martois | 81/57.16 |
| 2,576,203 | A * | 11/1951 | Wilson | 81/57.15 |
| 2,758,493 | A * | 8/1956 | Goldwater | 81/58.2 |
| 3,752,016 | A | 8/1973 | Ballard | |
| 3,774,481 | A * | 11/1973 | Goodman | 81/57.13 |
| 3,982,449 | A | 9/1976 | Choate, Jr. | |
| 4,092,881 | A * | 6/1978 | Jurgens et al. | 81/57.34 |
| 4,095,494 | A * | 6/1978 | Castoe | 81/63.2 |
| 4,098,151 | A * | 7/1978 | Bliss | 81/57.3 |
| 4,178,817 | A | 12/1979 | Gibson | |
| 4,306,471 | A * | 12/1981 | Bottoms | 81/57.33 |
| 4,729,269 | A | 3/1988 | Killian | |
| D390,764 | S | 2/1998 | Boyd et al. | |
| 6,739,221 | B2 * | 5/2004 | Cha | 81/57.13 |

* cited by examiner

*Primary Examiner*—Joseph J. Hail, III
*Assistant Examiner*—Bryan R. Muller

(57) ABSTRACT

A pipefitting engaging tool assembly includes a housing that has a bottom wall and a peripheral wall. A head is attached to the housing and has a circular opening extending therethrough. The opening is defined by an outer edge that has a slot therein continually extending around the outer edge. A ring member has an outer perimeter edge and an inner perimeter edge. The inner perimeter edge has a plurality of teeth attached thereto and extends inwardly of the ring member. The teeth are configured to engage a pipefitting. The ring member is positioned in the slot in the outer edge of the opening. A drive assembly is mounted in the housing and is mechanically coupled to the ring member to selectively rotate the ring member in a first direction or a second direction.

5 Claims, 11 Drawing Sheets

PIPEFITTING ENGAGING TOOL ASSEMBLY

BACKGROUND OF THE INVENTION

1. Field of the Invention

The present invention relates to pipefitting engaging tools and more particularly pertains to a new pipefitting engaging tool for positioning around a pipefitting and selectively loosening or tightening the pipefitting on a pipe by way of a powered tool.

2. Description of the Prior Art

The use of pipefitting engaging tools is known in the prior art. U.S. Pat. No. 4,178,817 describes a powered pipe wrench for engaging and rotating a pipe fitting. Another type of pipefitting engaging tool having a similar use and structure to that found above is U.S. Pat. No. 3,774,481. Still yet another powered pipe wrench is found in U.S. Pat. No. 4,729,269 that includes a jaw assembly having a toothed gear mounted in the jaw assembly. The toothed gear may be brought into communication with a pipefitting and then rotated with a motor so that the pipefitting is also rotated.

While these devices fulfill their respective, particular objectives and requirements, the need remains for a powered device that is adapted for being receiving and rotating a plurality of different sized pipefittings. Additionally, the device should include a means for securing a pipe with respect to a pipefitting.

SUMMARY OF THE INVENTION

The present invention meets the needs presented above by generally comprising a housing that has a bottom wall and a peripheral wall that is attached to and extends upwardly from the bottom wall. A head is attached to an upper end of the peripheral wall. The head has first side, a second side and a peripheral edge. The head has an opening extending therethrough that extends through the first and second sides. The opening has a generally circular shape. The opening is defined by an outer edge that has a slot therein continually extending around the outer edge. A ring member has an outer perimeter edge and an inner perimeter edge. The inner perimeter edge has a plurality of teeth attached thereto and extends inwardly of the ring member. The teeth are configured to engage a pipefitting. The ring member is positioned in the slot in the outer edge of the opening. A drive assembly is mounted in the housing and is mechanically coupled to the ring member to selectively rotate the ring member in a first direction or a second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
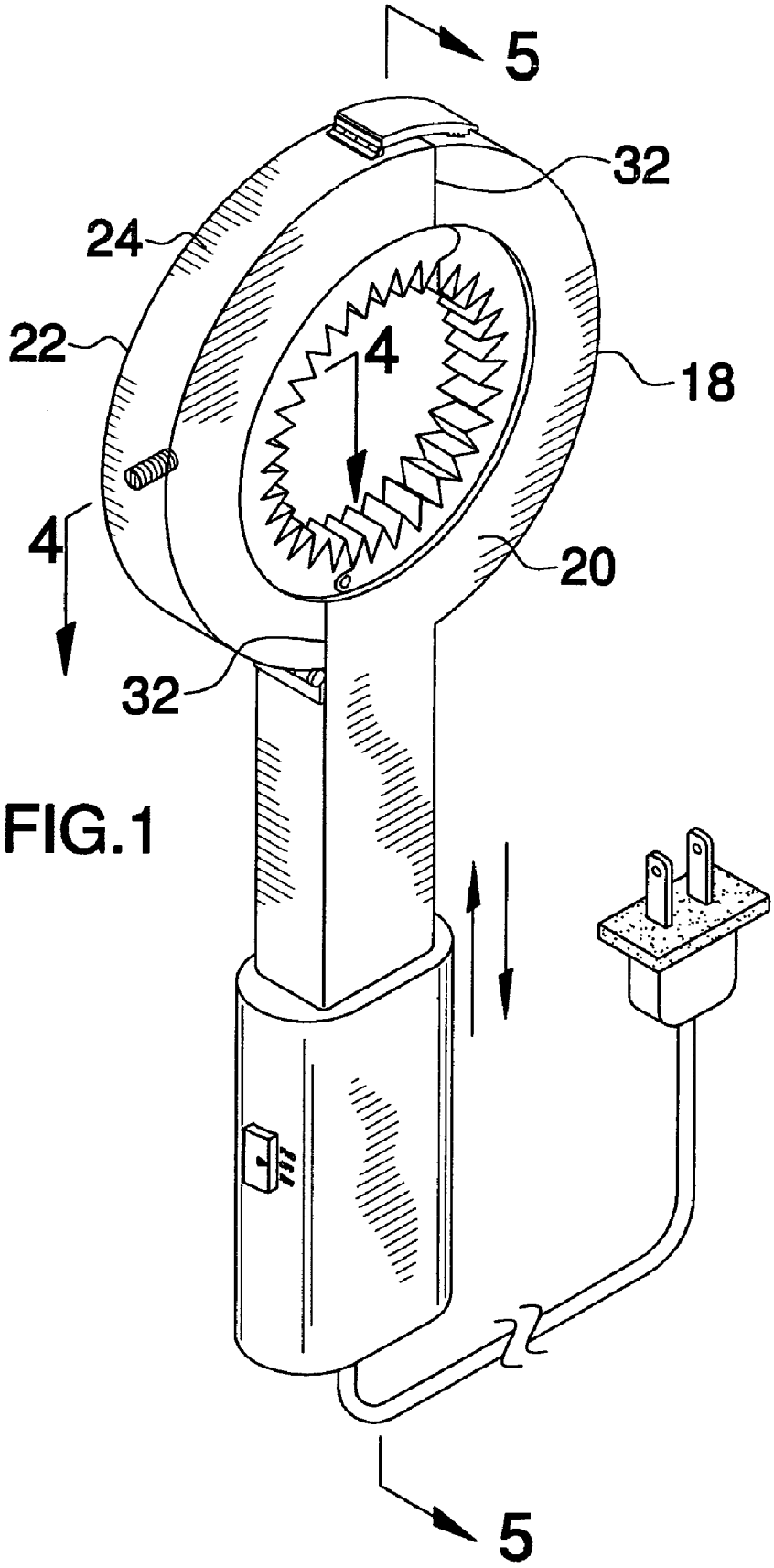
FIG. 1 is a perspective view of a first embodiment of a pipefitting engaging tool assembly according to the present invention.
Figure 2:
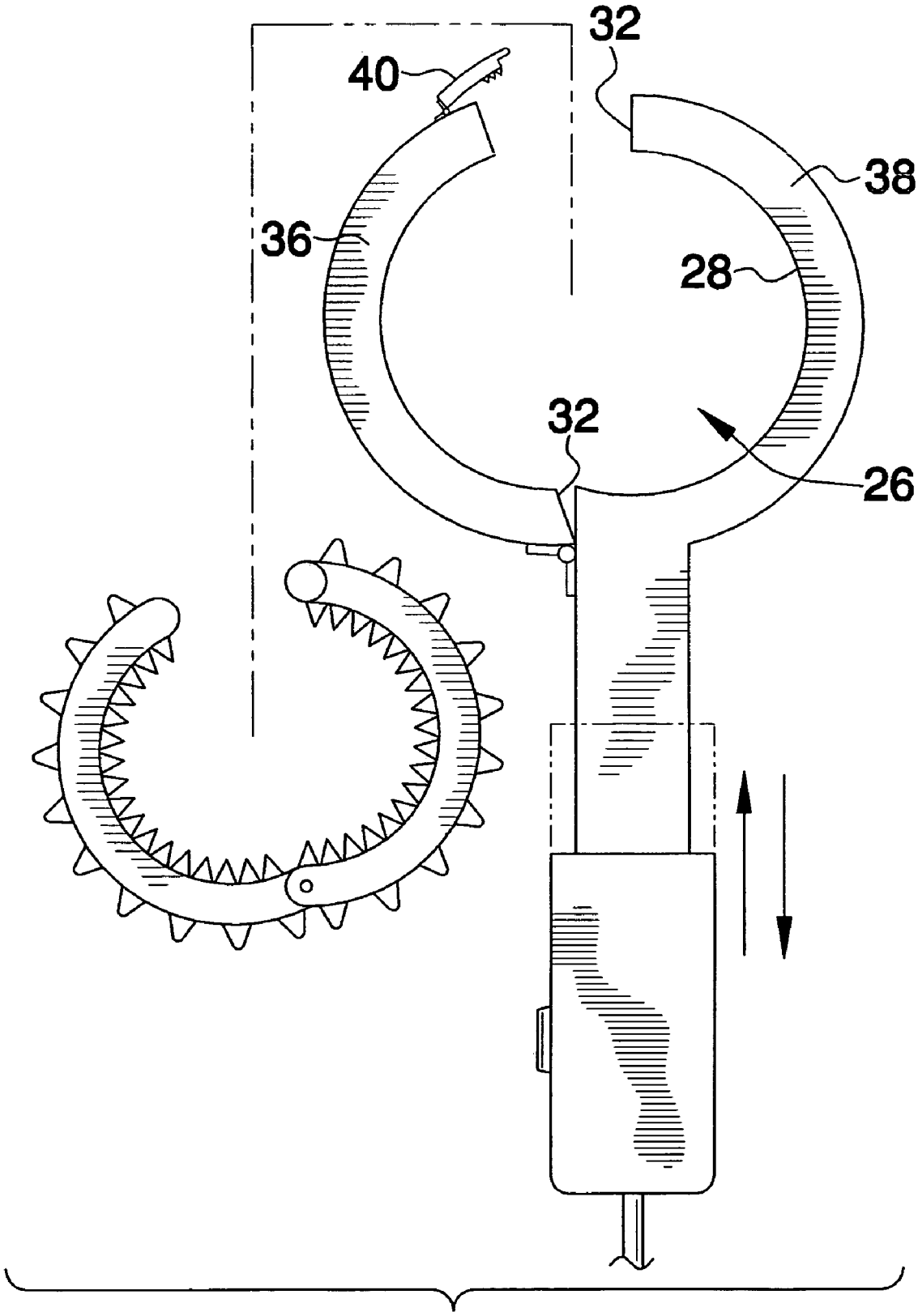
FIG. 2 is a front view of the present invention.
Figure 3:
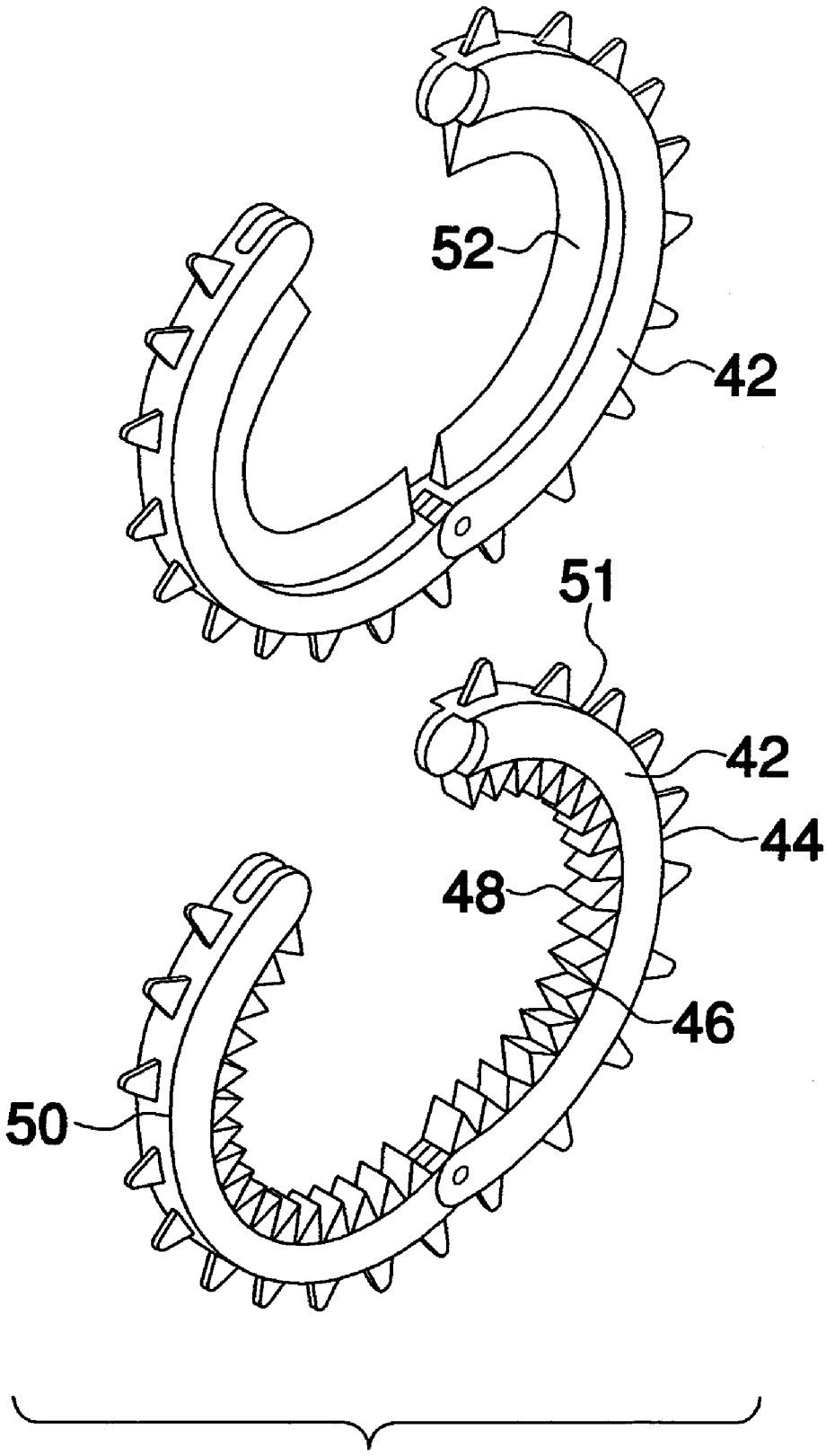
FIG. 3 is a perspective view of ring members of the present invention.
Figure 4:
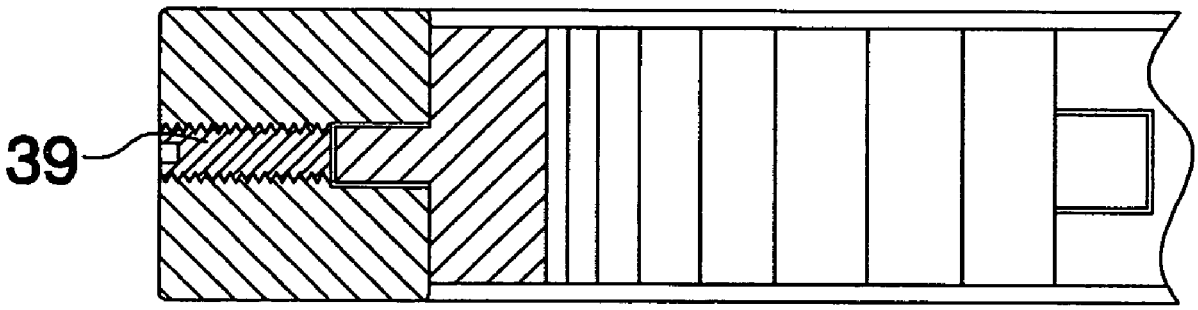
FIG. 4 is a cross-sectional view taken along line 4-4 of FIG. 1 of the present invention.
Figure 5:
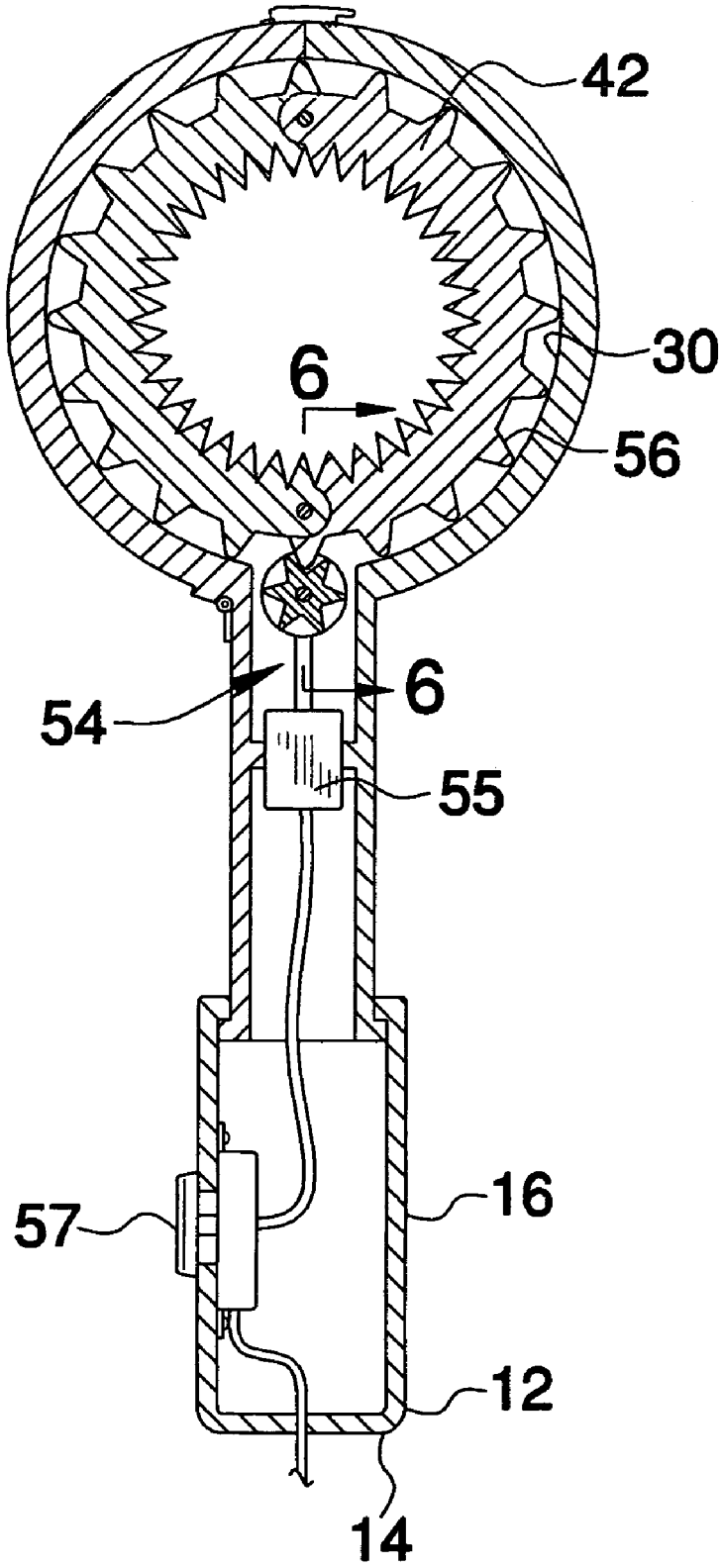
FIG. 5 is a cross-sectional view taken along line 5-5 of FIG. 1 of the present invention.
Figure 6:
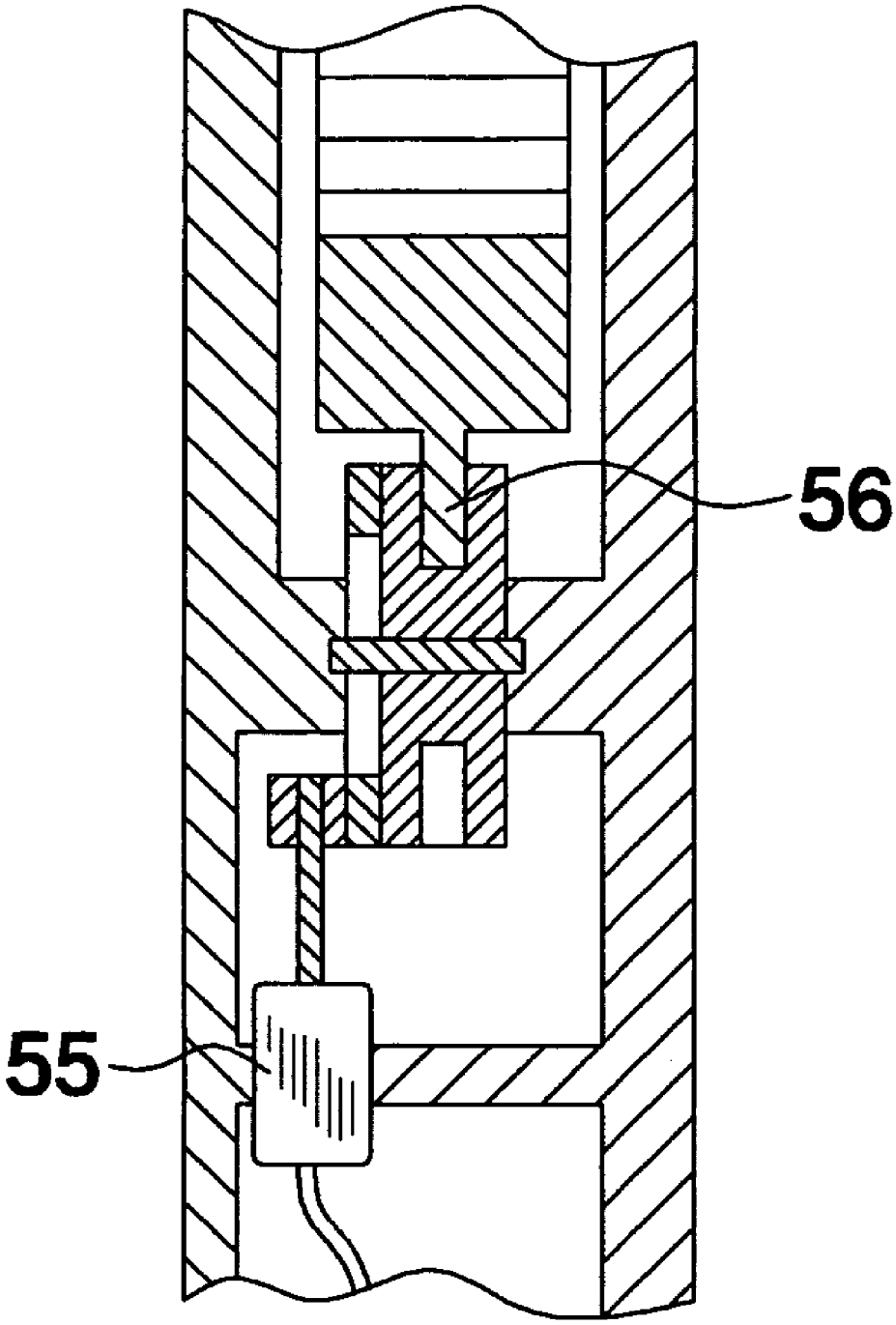
FIG. 6 is a cross-sectional view taken along line 6-6 of FIG. 5 of the present invention.
Figure 7:
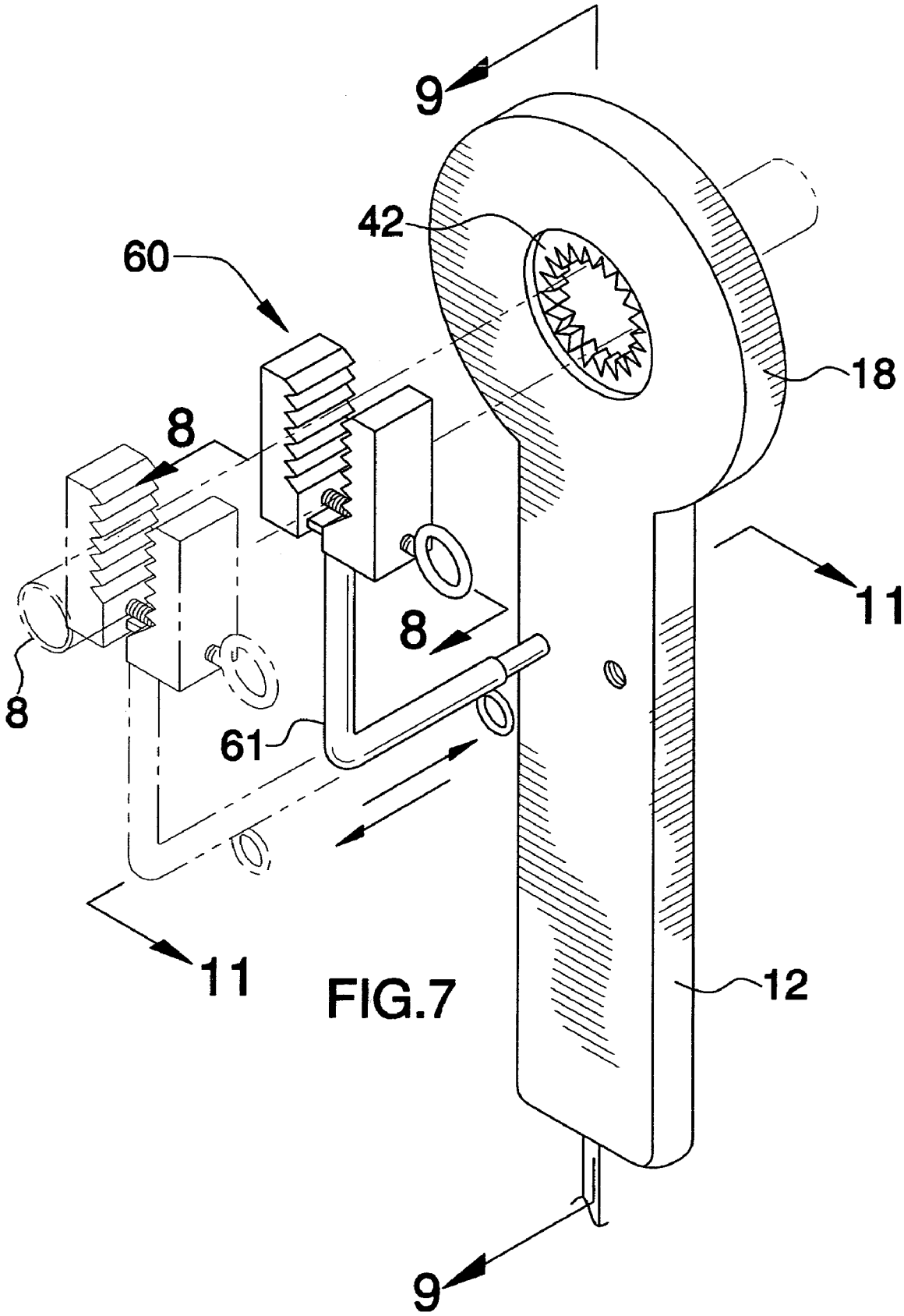
FIG. 7 is a perspective view of a second embodiment of the present invention.
Figure 8:
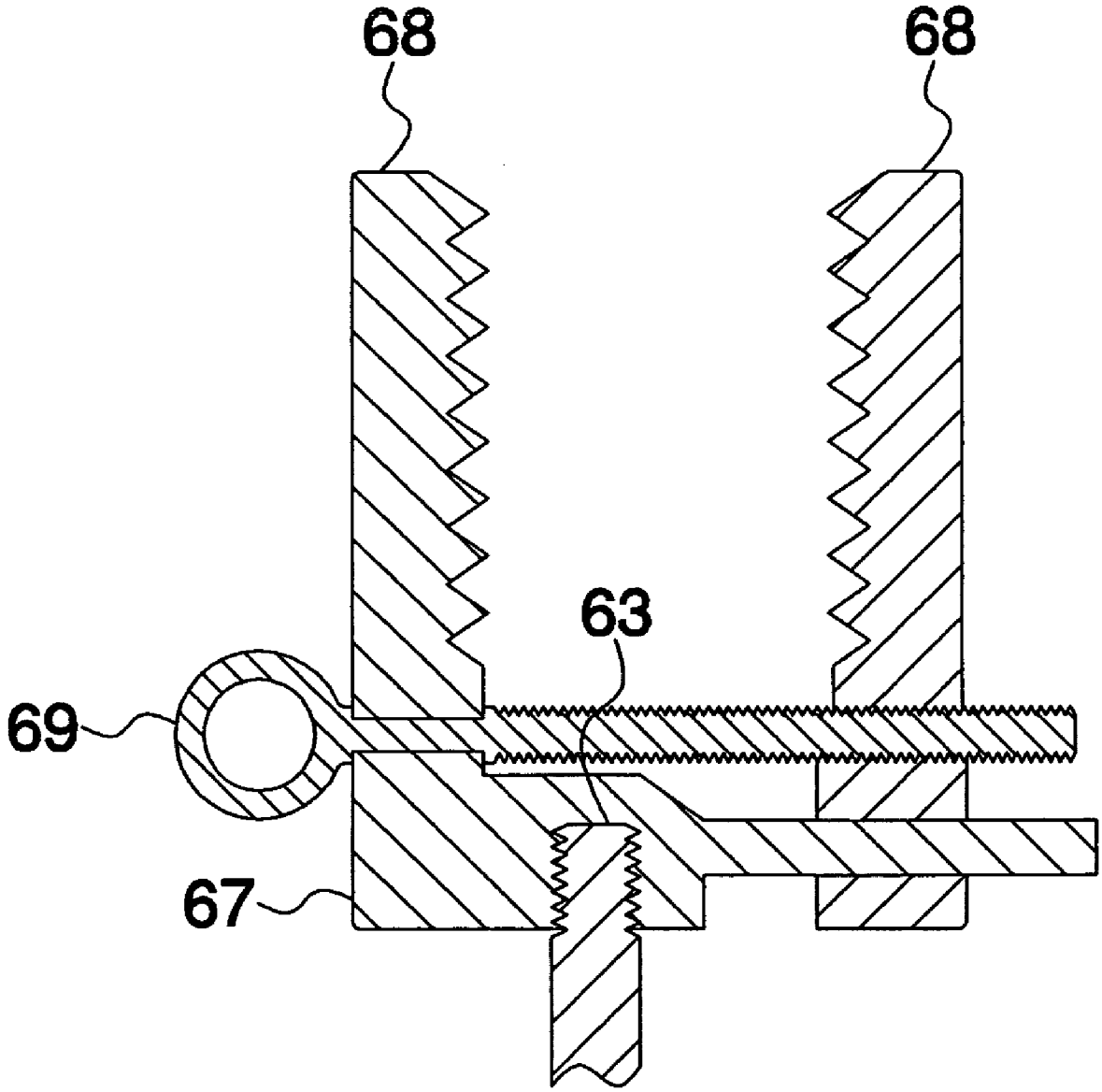
FIG. 8 is a cross-sectional view taken along line 8-8 of FIG. 7 of the present invention.
Figure 9:
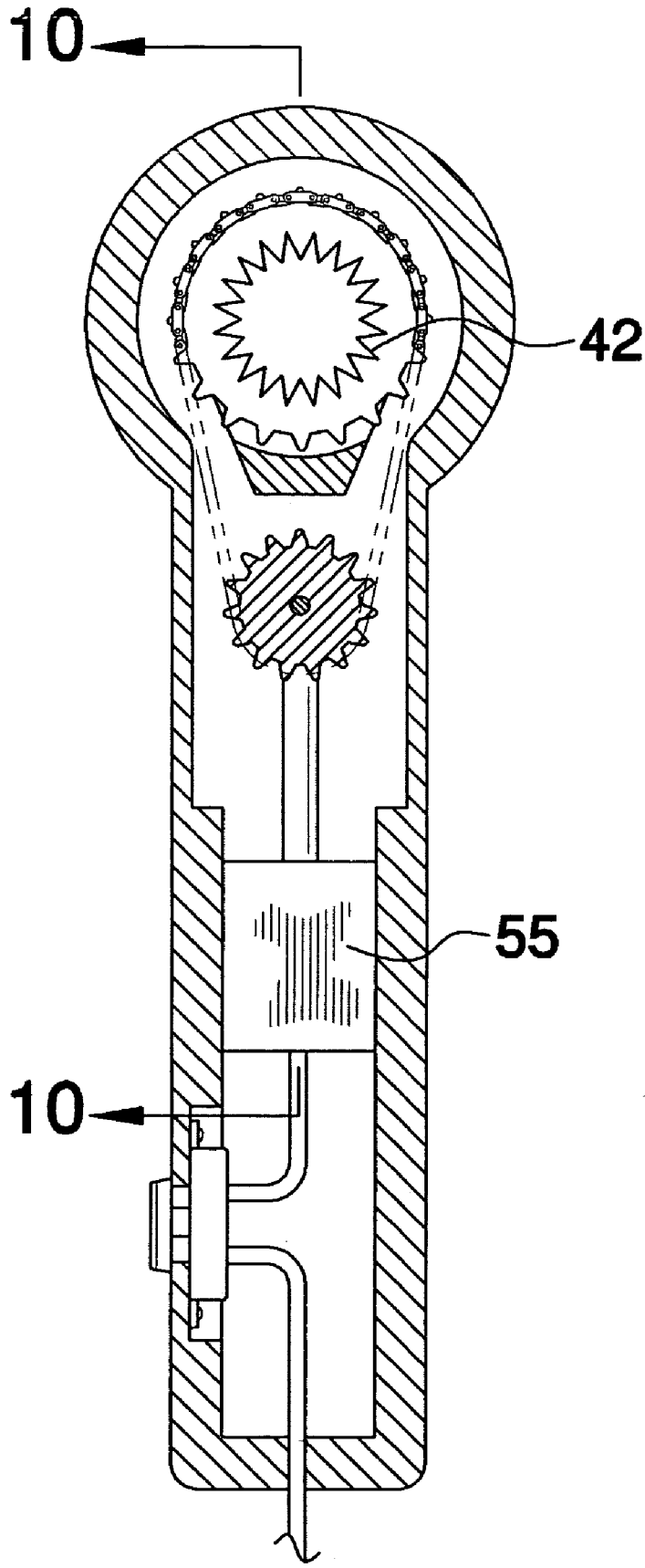
FIG. 9 is a cross-sectional view taken along line 9-9 of FIG. 7 of the present invention.
Figure 10:
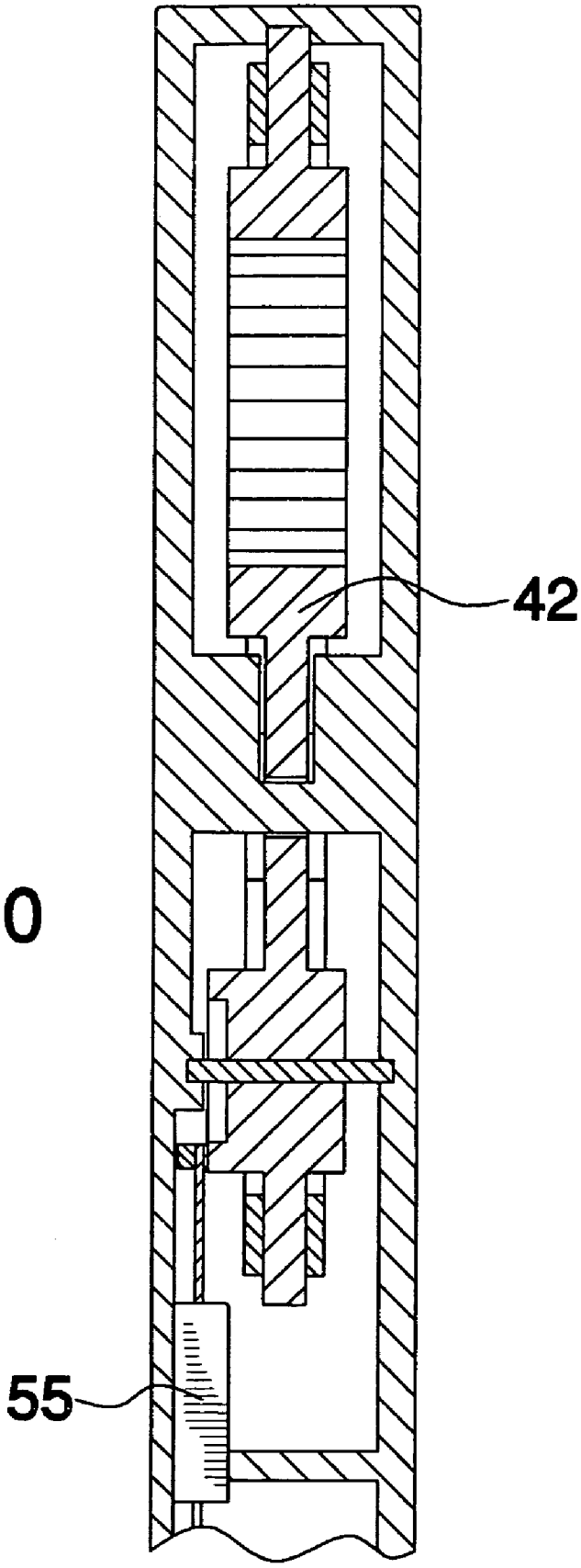
FIG. 10 is a cross-sectional view taken along line 10-10 of FIG. 9 of the present invention.
Figure 11:
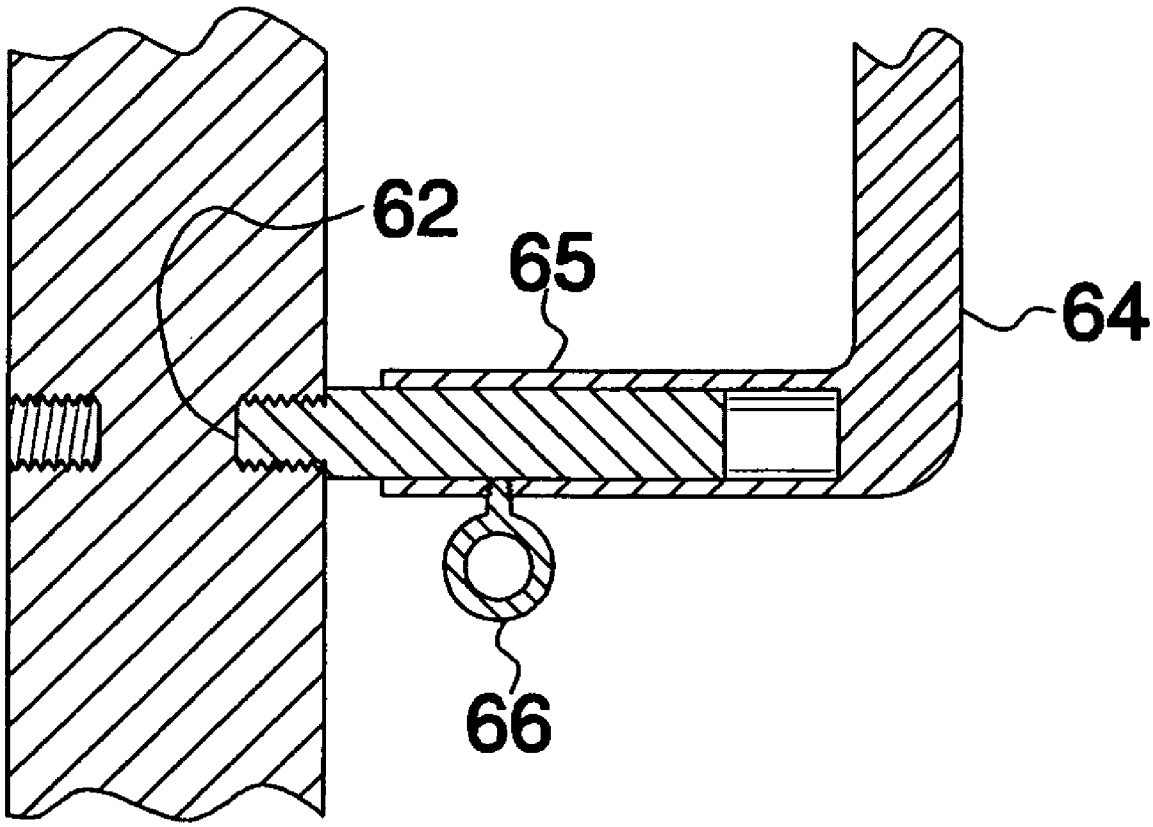
FIG. 11 is a cross-sectional view taken along line 11-11 of FIG. 7 of the present invention.

With reference now to the drawings, and in particular to FIGS. 1 through 11 thereof, a new pipefitting engaging tool embodying the principles and concepts of the present invention and generally designated by the reference numeral 10 will be described.

As best illustrated in FIGS. 1 through 11, the pipefitting engaging tool assembly 10 generally comprises a housing 12 that has a bottom wall 14 and a peripheral wall 16 that is attached to and extends upwardly from the bottom wall 14. The housing 12 is elongated and defines a handle of the tool assembly 10.

A head 18 is attached to an upper end of the peripheral wall 16. The head 18 has first side 20, a second side 22 and a peripheral edge 24. The head 18 has an opening 26 extending therethrough. The opening 26 extends through the first 20 and second 22 sides and has a generally circular shape. The opening 26 is defined by an outer edge 28. The outer edge 28 has a slot 30 therein continually extending around the outer edge 28. In a first embodiment of the assembly, the head 18 has a pair of breaks 32 therein. The breaks 32 extend into the peripheral edge 24 and through the outer edge 28 of the opening 26 so that a first section 36 and a second section 38 of the head 18 are defined. The first 36 and second 38 sections are hingedly coupled together and are selectively positionable in an open position or in a closed position. A locking member 40 is mounted on the head 18 for selectively locking the first 36 and second 38 sections in the closed position. An oil pin 39 may be removed from the head 18 to add oil to the slot 30.

A ring member 42 has an outer perimeter edge 44 and an inner perimeter edge 46. The inner perimeter edge 46 has a plurality of teeth 48 attached thereto and that extend inwardly of the ring member 42. The teeth 48 are configured to engage a pipefitting. The ring member 42 is positioned in the slot 30 in the outer edge 28 of the opening 26. The ring member 42 is removable from the opening 26 when the head 18 is placed in the open position. The ring member 42 may also be separated into a first portion 50 and a second portion 51 that are hingedly coupled together and are selectively positionable in a ring configuration or in an open configuration. A cutting blade 52 for cutting a portion of pipe may replace the teeth 48.

A drive assembly 54 is mounted in the housing 12. The drive assembly 54 is mechanically coupled to the ring member 42 and is configured to selectively rotate the ring member 42 in a first direction or a second direction. The drive assembly 54 includes a motor 55 mechanically coupled to a plurality of cogs 56 that are attached to and extend outwardly from the outer perimeter edge 44 of the ring member 42. An actuator 57 is operationally coupled to the motor 55 for turning the motor 55 on in a first direction or a second direction. The motor 55 is preferably an electric motor and a power plug is electrically coupled to the motor 55.

A clamp assembly 60 is removably coupled to the housing 12 and is configured to secure a pipe to the housing 12 such that a pipe 8 is aligned with the opening 26. The clamp assembly 60 includes a rod 61 having a first end 62 and a second end 63. A perpendicular bend 64 is positioned between the first 62 and second 63 ends. A first portion 65 of the rod 61 between the bend 64 and the first end 62 is preferably telescoping. A fastener 66 allows a length of the first portion 65 be selective secured. The first end 62 is removably extendable into and threadably coupled to the housing 12. A clamp 67, of the clamp assembly 60, is attached to the second end 63 of the rod 61. The clamp 67 includes a pair of jaws 68 selectively movable toward or apart from each other with a coupler 69.

In use, the ring member 42 is placed around and engaged to a pipefitting. The motor 55 is turned on and the ring member 42 rotates to tighten, or loosen the pipefitting depending on rotation of the motor 55. By allowing the head 18 to be selectively opened, the ring member 42 may be replaced with alternately sized ring members 42. If needed, to aid a person in preventing the pipe 8 from rotating, the clamp 60 may be attached to the pipe.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pipe wrench apparatus comprising:

a housing having a bottom wall and a peripheral wall being attached to and extending upwardly from said bottom wall;

a head being attached to an upper end of said peripheral wall, said head having first side, a second side and a peripheral edge, said head having an opening extending therethrough, said opening extending through said first and second sides, said opening having a generally circular shape, said opening being defined by an outer edge, said outer edge having a slot therein continually extending around said outer edge;

a ring member having an outer perimeter edge and an inner perimeter edge, said inner perimeter edge having a plurality of teeth attached thereto and extending inwardly of said ring member, said teeth being configured to engage a pipefitting, said ring member being positioned in said slot in said outer edge of said opening;

a drive assembly being mounted in said housing, said drive assembly being mechanically coupled to said ring member and being configured to selectively rotate said ring member in a first direction or a second direction; and a clamp assembly being removably coupled to said housing and being configured to secure a pipe to said housing such that said pipe is aligned with said opening, said clamp assembly including a rod having a first end and a second end, a perpendicular bend being positioned between said first and second ends of said rod, said first end of said rod being removably extended into and threadably coupled to said housing, a clamp of said clamp assembly being attached to said second end of said rod, said clamp including a pair of jaws, a coupler extending through said jaws being adjustable to selectively move said jaws toward or apart from each other, an opening between said jaws being aligned with said opening in said head.

2. The apparatus according to claim 1, wherein said head has a pair of breaks therein, each of said breaks extending into said peripheral edge and through said outer edge of said opening such that a first section and a second section of said head is defined, said first and second sections being hingedly coupled together and being selectively positionable in an open position or in a closed position, a locking member being mounted on said head for selectively locking said first and second sections in said closed position, said ring member being removable from said opening when said head is placed in said open position.

3. The apparatus according to claim 2, wherein said ring member is separated into a first portion and a second portion, said first and second portions being hingedly coupled together and being selectively positionable in a ring configuration or in an open configuration.

4. A pipe wrench apparatus comprising:

a housing having a bottom wall and a peripheral wall being attached to and extending upwardly from said bottom wall;

a head being attached to an upper end of said peripheral wall, said head having first side, a second side and a peripheral edge, said head having an opening extending therethrough, said opening extending through said first and second sides, said opening having a generally circular shape, said opening being defined by an outer edge, said outer edge having a slot therein continually extending around said outer edge, said head having a pair of breaks therein, each of said breaks extending into said peripheral edge and through said outer edge of said opening such that a first section and a second section of said head is defined, said first and second sections being hingedly coupled together and being selectively positionable in an open position or in a closed position, a locking member being mounted on said head for selectively locking said first and second sections in said closed position;

a ring member having an outer perimeter edge and an inner perimeter edge, said inner perimeter edge having a plurality of teeth attached thereto and extending inwardly of said ring member, said teeth being configured to engage a pipefitting, said ring member being positioned in said slot in said outer edge of said opening, said ring member being removable from said opening when said head is placed in said open position, said ring member being separated into a first portion and a second portion, said first and second portions being hingedly coupled together and being selectively positionable in a ring configuration or in an open configuration;

a drive assembly being mounted in said housing, said drive assembly being mechanically coupled to said ring member and being configured to selectively rotate said ring member in a first direction or a second direction, said drive assembly including a motor mechanically coupled to a plurality of cogs being attached to and extending outwardly from said outer perimeter edge of said ring member, an actuator being operationally coupled to said motor for turning said motor on in a first direction or a second direction; and a clamp assembly being removably coupled to said housing and being configured to secure a pipe to said housing such that said pipe is aligned with said opening, said clamp assembly including a rod having a first end and a second end, a perpendicular bend being positioned between said first and second ends of said rod, a first portion of said rod being defined between said bend and said first end of said rod, said first portion being telescoping, a fastener extending into said first portion to secure said first portion at a selected length, said first end of said rod being removably extended into and threadably coupled to said housing, a clamp of said clamp assembly being attached to said second end of said rod, said clamp including a pair of jaws, a coupler extending through said jaws being adjustable to selectively move said jaws toward or apart from each other, an opening between said jaws being aligned with said opening in said head.

5. The apparatus according to claim 1, wherein a first portion of said rod is defined between said bend and said first end of said rod, said first portion being telescoping, a fastener secures extends into said first portion and secure said first portion at a selected length.

* * * * *